United States Patent [19]

Fister, Jr.

[11] 3,988,034

[45] Oct. 26, 1976

[54] CHAIR AND SOFA CONSTRUCTION

[76] Inventor: Lee Harold Fister, Jr., 7715 Park Creek Drive, Dayton, Ohio 45459

[22] Filed: July 3, 1975

[21] Appl. No.: 593,172

[52] U.S. Cl. ..... 297/455; 297/DIG. 1

[51] Int. Cl.[2] ..... A47C 1/02

[58] Field of Search ..... 297/458, 452, 456, 219, 297/455, 226, DIG. 1; 5/DIG. 2, 356, 12 R, 338; 160/383, 382; 24/90 B, 152, 72.5

[56] References Cited

UNITED STATES PATENTS

| | | | |
|---|---|---|---|
| 1,616,349 | 2/1927 | Cagle | 24/90 B |
| 1,963,710 | 6/1934 | Mitchell | 5/356 X |
| 2,940,087 | 1/1960 | Kiefer | 5/338 |
| 3,033,613 | 5/1962 | Dudley | 297/219 |
| 3,070,402 | 12/1962 | Stanton | 5/DIG. 2 |
| 3,266,066 | 8/1966 | Bereday | 297/452 X |
| 3,630,572 | 12/1971 | Homier | 297/219 X |
| 3,727,980 | 4/1973 | Tischler | 297/452 |
| 3,766,577 | 10/1973 | Stewart | 5/12 R |

FOREIGN PATENTS OR APPLICATIONS

| | | | |
|---|---|---|---|
| 3,030,094 | 4/1971 | Germany | 297/452 |
| 472,664 | 9/1937 | United Kingdom | 297/452 |

*Primary Examiner*—James T. McCall

*Attorney, Agent, or Firm*—Wood, Herron & Evans

[57] ABSTRACT

The invention herein disclosed relates to improved seating units, chairs or sofas, the major component of which comprises a resilient, foam material. A relatively thin base is provided. In final upholstered form the base is hidden from sight during normal use. The seating units have a seat and back portion. Cooperating with the seat and back portion is a rigid rod which is attached to the upholstery which covers the seat and back portions and extends across the width of the seat portion in a slot left unglued between blocks of foam, at the back portion-seat portion juncture. Means, as for example chains, are provided to pull the bar downwardly toward the base and to secure the chains to the base.

10 Claims, 3 Drawing Figures

CHAIR AND SOFA CONSTRUCTION

BACKGROUND OF THE INVENTION

This invention relates generally to "all foam" seating units having novel elements cooperating to provide a comfortable, durable and aesthetically pleasing sofa or chair. As used hereinafter, "all foam unit" is intended to mean a seating unit which depends principally upon a resilient material such as foam rubber for providing a comfortable seating unit for people and which is upholstered.

All foam seating units are well known. Most frequenty, conventional all foam seating units utilize an internal or external frame to maintain their rigidity and form. Such frames normally fix and maintain the relationship of the back and seat portion during occupancy. With external frames an unbroken, unencumbered appearance is difficult to obtain. With internal frames the cost and ease of manufacture is increased. In conventional all foam seating units their manufacture is complicated by the traditional techniques employed for upholstering. Such techniques result in increased labor costs which in turn increase the finished cost of the seating unit.

It has been an important objective of this invention to provide a seating unit which may be easily, quickly and inexpensively mnaufactured. Two major expenses of manufacturing upholstered furniture are labor time consumed inapplying fabric parts to the form and the quantity of fabric required to cover conventional forms. This invention reduces both labor time and fabric requirements substantially.

It has been another objective to provide a comfortable, aesthetically pleasing chair whose lines are unbroken by an external frame.

It has been another objective of this invention to provide a simple, concealed means for quickly and permanently securing the back and seat portions of a seating unit to the base in a functional relationship which means also serves as one of the principal means used in the upholstering of the seating unit.

It has been another objective of this invention to provide a new and improved upholstering and reupholstering technique. If at a future date the seating unit is desired to be recovered, a new cover can be furnished by the manufacturer and applied in place of the old cover.

SUMMARY OF THE INVENTION

The all foam seating units disclosed herein are of contemporary design and are characterized by their unencumbered appearance. More particularly, the seating units disclosed herein comprise a base portion, a seat and back portion made of a resilient foam material, an upholstery material, and a rigid bar which cooperates with the upholstery material, seat and back portions, and base to retain the desired relationship between the seat and back portions and to provide a partial means for securing the upholstery fabric to the chair.

The seat and back portions of the seating unit are made from conventional foam materials, utilizing different compressive strengths in the manner hereinafter described. They are adhesively secured to each other and to a relatively thin base whose perimeter is approximately the same shape and size as the seat portion. The seat portion includes a transverse slot at the seat-back juncture.

Suitable fabric is cut and stitched to form a fabric envelope or cover which is open at its bottom and which can be slipped over the base, seat and back. Sewn to the inner side of the fabric cover is a pocket which extends across the width of the inner side of the seat fabric portion adjacent to the inner side of the fabric that ultimately will encircle the back portion.

The fabric pocket receives the aforementioned rigid rod. Affixed to the rod are rod securing means, as for example, chains which, when the fabric cover is slipped over the back and seat portions and the rigid rod placed in the transverse slot at the juncture of the seat and back portions, are pulled downwardly and tentatively secured to the base. The fabric is then secured to the base in a suitable manner as for example by stapling. After the stapling of the fabric, the chains are further tensioned and anchored to the base.

The foregoing generally described seating unit and assembly technique provides a number of advantages heretofore unattainable. Firstly, a quick, easy and relatively inexpensive technique is provided for producing a very aesthetically pleasing seating unit. The amount of fabric material and labor time required are substantially reduced as compared to prior art methods of construction. Furthermore, a contemporary design is provided whose lines are not cluttered or broken by external frames. This construction also eliminates costly internal frames.

Of significant importance also is the advantage that is derived from the rigid rod providing a means to maintain the desired functional relationship between the seat and back portions. Pulling the rigid rod downwardly as described creates a force which insures that when one sits down in the chair the back portion is stabilized and cannot be easily moved in an undesirable rearwardly fashion.

Of substantial advantage also is the contouring of the fabric and the foam material thereunder by the tensioning of the rigid rod. Such provides not only an aesthetically pleasing appearance without molding the foam to a predetermined shape which is maintained even after substantial usage but also provides a way to alter the seating or physical characteristics of the foam. This latter advantage results from the creation of compressive forces in the foam. These forces are extremely important in some seatingunits because they insure that the occupant, whatever normal weight, will be seated at a predetermined height. This is especially important in dining chairs since the occupant must be seated at the proper height determined by the height of the dining table. The compression of the foam and the maintenance of the seat back portion's functional relationship is also important to achieve a comfortable seating unit.

Figure 1:
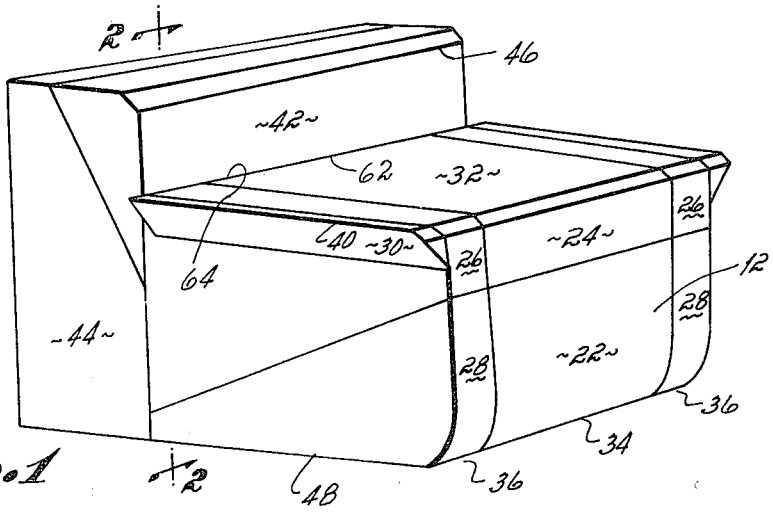
FIG. 1 is a perspective view of an all foam chair showing only the foam elements utilized in the construction of my chair.

Referring now to the Figures, my novel seating unit is shown in an armless chair form. The chair consists of the basic following elements: a base 10, a seat portion 12, a back portion 14, upholstery fabric 16, a rigid rod 18, and rigid rod securing means generally depicted by the number 20.

More particularly, the chair shown in the drawings has the following dimensions: (1) width, 32 inches; (2) height, 25 inches; (3) seat depth, 23 inches; (4) seat height, 17 inches; (5) back height above seat, 8 inches; and (6) back thickness, 9 inches.

Referring now to FIG. 1, the component parts of the all foam construction will now be described. The seat portion comprises foam pieces 22, 24, 26, 28, 30 and 32 having the following compressive strengths:

| FOAM PIECE NUMBER | COMPRESSIVE STRENGTH IN POUNDS |
|---|---|
| 22 | 50 |
| 24 | 10 |
| 26 | 10 |
| 28 | 50 |
| 30 | 30 |
| 32 | 10 |

The foam is of the polyether urethane type and is commercially available. Foam piece 22 has a 3 inch radius buff 34 at the bottom as do foam pieces 28 at their lowermost portions 36. Foam piece 32 has a 1½ inch bevel 38 at its front edge. The thickness of foam piece 30 at its uppermost portion 40 is about 1 inch.

All of the elements forming the seat portion 12, just described, are adhesively secured to each other using a conventional foam adhesive. In some applications it may be desirable to secure a relatively thin poly-fiber or four pound foam layer to the seat portion 12 and back portion.

Back portion 14 comprises two foam pieces 42 and 44 made from 70# and 7#, respectively, conventional foam. Foam piece 42 has a 1 inch bevel cut along edge 46. Foam pieces 42 and 44 are adhesively secured to each other using a conventional foam adhesive.

Base 10 is made from commercially obtainable hardboard as for example, Novaply or Celotex Baraboard brands, and its perimeter is slighty smaller than the size and shape as the bottom 48 of the foam pieces 44, 28 and 22 after the latter have been adhesively joined. The base includes a plurality of countersunk holes 50 (only one shown) adapted to receive the rigid rod securing means 20. If desired, the base may include channels, not shown, around its perimeter, for receiving the fabric 16. Also the base may include metal or any material caps 52 placed at the corners of the base and glides or casters over the countersunk holes 50 after final assembly.

Figure 2:
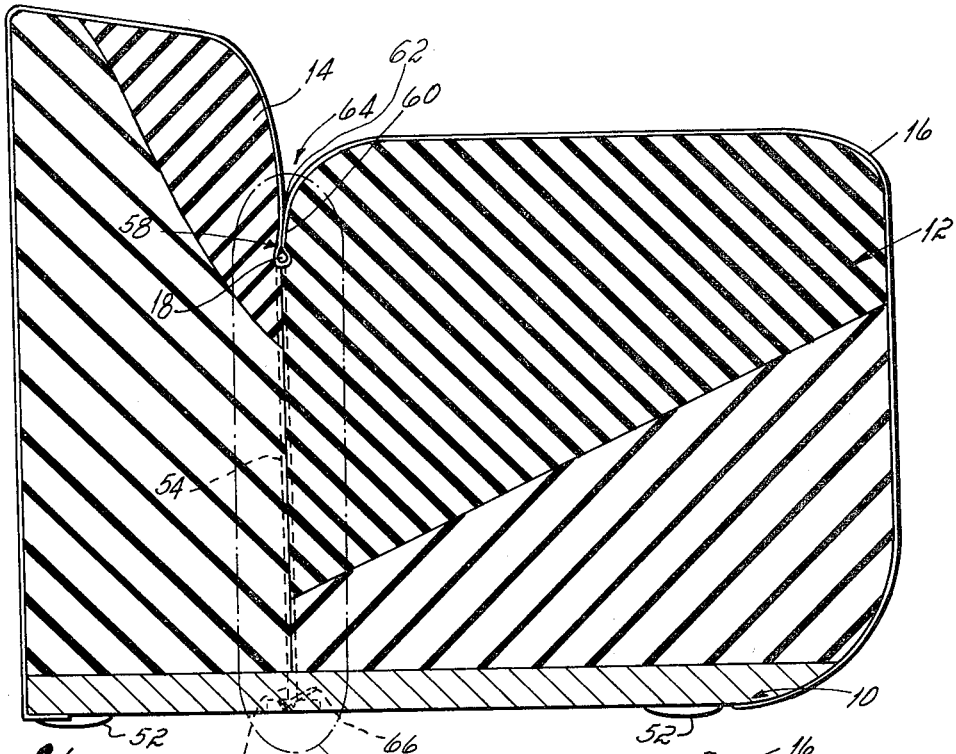
FIG. 2 is a cross sectional view taken along the lines 2—2 of FIG. 1 and including the other elements of my chair.
Figure 3:
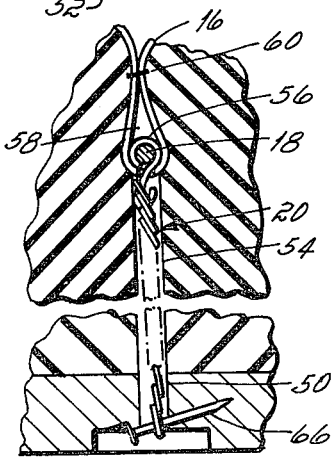
FIG. 3 is an enlarged fragmentary view of the encircled area of FIG. 2 showing in more detail the rigid rod and the means provided for attaching it to the base.

Referring now to FIGS. 2 and 3, the rigid rod 18 and rigid rod securing means 20 will now be described. In the chair shown in the drawings the rigid rod is ⅜ inch diameter cold rolled steel. It is extremely important that a material and rod diameter are selected so as to provide a rod which is rigid and which will not flex in use. Its length is slightly less than the width of the seat portion 12.

Rod securing means 20 comprise chains 54 and means for securing the chains 54 to the rigid rod 18. So that chains 54 may be easily slipped in assembly through the foam material, chains 54 are preferably of the steel sash type, i.e., Turner & Seymour No. 8 SRP 350 lb. tensile, 75 lb. working load. This type may be readily pulled through the foam. As shown the rod securing means 20 includes S-shaped hooks 56 that are passed through the last link in the chain 54, around the bar and then their ends bent to secure the chain 54 to the rigid rod 18. Only one chain 54 is shown in the drawings. In practice more than one chain 54 is employed and also more than one S-shaped hook is employed. For a chair of the type described, two are sufficient. Wider chairs, sofas, etc., may require more. Foreach chain a countersunk hole 50 is formed in the base 10.

Rigid rod 18 is encased or carried by a pocket 58 sewn to the fabric 16 or as shown formed from the fabric 16 by doubling the seat fabric 16 and sewing it across the seat width at 60. The pocket 58 is formed in the fabric 16 at a location which will place it at the seat portion-back juncture 62. At this juncture 62, and extending across the width of the seat portion 12 is a slot 64 which is adapted to receive the rigid rod 18.

Febric 16 may be of any conventional upholstery material. A suitable pattern, not shown, is used to cut the required fabric pieces which are then sewed together to form an envelope or cover that can be slipped over the all foam structure of FIG. 1.

In constructing a chair of the type just described, the foam pieces 22–32 are cut and adhesively secured to each other. So, too, are the foam pieces 44 and 42 which form the back portion 14. Before the seat portion 12 and back portion 14 are adhesively secured to each other, strings, not shown, are positioned in the adhesive is places and in the same locations as chains 54 will occupy during final assembly. During the time while the adhesiveis drying the strings are periodically moved so that they remain free and can be pulled. The seat portion 12 and back portion 14 are glued together a specified distance (nine inches) up from their bases, leaving slot 64 open to admit fabric and rod 18.

The seat portion 12 and back portion 14 are adhesively secured to base 10. The bottom ends of the afore mentioned strings are positioned through countersunk holes 50.

Rigid rod 18 is inserted in the pocket 58. S hooks 56 with one premeasured (twelve inch) chain 54 attached to one arc of each S hook are slipped around the rigid rod. If pocket 58 does not have holes permitting the insertion of S hooks 56 and their positioning around the rigid rod 18 such holes are formed. The S hooks 56 are positioned around the rigid rod 18 and the S hooks 56 crimped so that they cannot be pulled upwardly away from the rigid rod 18.

The strings, not shown, positioned between the back portion 14 and seat portion 12 are tied to the free ends of chains 54 opposite the end secured to the S hooks 56. The free ends of the strings are pulled so that the chains 54 are pulled through the chair and the countersunk holes 50. In some seating units small holes might have to be made so that the chains 54 can pass through the foam easily. As the chains are pulled through the chair and through the countersunk holes 50 the fabric 16 is positioned around the back portion 14 and the seat portion 12.

With some seating units it is preferable to pull rigid rod 18 downwardly in two or more steps so that the fabric 16 cover and the seat portion 12-back portion 14 can be adjusted. In order to hold the rigid rod 18 in position at any step a small rod or nail can be inserted through a link in chain 54 so that the chain 54 cannot be pulled upwardly. Fabric 16 is then stapled to the base 10, preferably in a channel, not shown, extending around the perimeter of the base 10. After the final tensioning has been performed to adjust foam shape, compression and pitch of back in relation to seat, a nail 66 is driven through the lowermost links of chains 54 and into the base 10 and excess links of chain cut off.

To those skilled in the art it will be readily apparent that the seating construction of this invention is applicable to other types of seating units. For example, it may be employed to manufacture the seating units shown in my copending Design patent applications, Ser. Nos. 548,233 and 548,275, filed Feb. 10, 1975, incorporated by reference herein. In the manufacture of the '275 chair essentially the same construction technique would be utilized except that rigid rod 18 would be utilized not only in the same location as described herein but also two additional rigid rods 18 would be utilized to form the crevices between the seat and arms, best viewed in FIG. 3 of the '275 application. Using this type construction, one can produce a chair that appears to have a separate seat cushion, functions in use as though it did, but which does not require the additional fabric necessary to make a six sided seat cushion. In the manufacture of the '233 "Oblique Sofa" one rigid rod 18, bent in the same form as the seat-back portion would be employed or three rigid portion rods 18 could be used.

It will also be apparent that other shape back portion seat portion junctures may dictate other shapes of rigid rods 18 or the use of a plurality thereof.

Having thus described my invention, I claim:

1. An improved foam seating unit comprising a plurality of foam pieces attached together to form seat and back portions, said seat portion having a transverse slot therein at its juncture with said back portion, a base attached to said seat portion, upholstery covering said seat and back portions, said upholstery covering having an inside transverse pocket, said transverse pocket lying in said transverse slot in said seat portion, a rigid rod in said transverse slot, rod securing means attached to said rod and extending through said seat portion, said rod securing means being pulled downwardly and secured to said base whereby the back and seat portions are stabilized relative to one another in use and whereby the fabric is positioned and contoured about said seating unit.

2. The seating unit of claim 1 wherein the rod securing means includes a plurality of chains.

3. The seating unit of claim 2 wherein the rod securing means includes a plurality of S-shaped hooks for securing said chains to said rigid rod.

4. The seating unit of claim 3 wherein the plurality of foam pieces include foam pieces of different compressive strengths.

5. The seating unit of claim 1 wherein there are a plurality of rigid rods and rod securing means.

6. The seating unit of claim 5 wherein the rod securing means includes a plurality of chains.

7. The seating unit of claim 6 wherein the rod securing means includes a plurality of S-shaped hooks for securing said chains to said rigid rod.

8. The seating unit of claim 7 wherein the plurality of foam pieces include foam pieces of different compressive strengths.

9. The seating unit of claim 1 wherein the foam pieces are adhesively attached together.

10. The seating unit of claim 1 wherein said upholstery cover consists of a pluraity of upholstery pieces sewn together to form a one-piece upholstery cover.

* * * * *

UNITED STATES PATENT AND TRADEMARK OFFICE

CERTIFICATE OF CORRECTION

PATENT NO. : 3,988,034

DATED : October 26, 1976

INVENTOR(S) : Lee Harold Fister, Jr.

It is certified that error appears in the above-identified patent and that said Letters Patent are hereby corrected as shown below:

Column 1, line 30, "inapplying" should be --in applying--.

Column 2, line 47, "seatingunits" should be --seating units--.

Column 4, lines 9 and 10, "Fo-reach" should be --For each--.

Column 4, line 20, "Febric" should be --Fabric--.

Column 4, line 31, delete "adhesive is" and insert --same--.

Column 4, line 23,"adhesiveis" should be --adhesive is--.

Column 5, line 28, after "portion" insert -- - --.

Column 6, line 35, "pluraity" should be --plurality--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*